US007740745B2

(12) United States Patent
Nguyen et al.

(10) Patent No.: US 7,740,745 B2
(45) Date of Patent: Jun. 22, 2010

(54) NON-CARBON ANODES WITH ACTIVE COATINGS

(75) Inventors: Thinh T. Nguyen, Onex (CH); Vittorio De Nora, Veyras (IT)

(73) Assignee: Moltech Invent S.A., Luxembourg (LU)

( * ) Notice: Subject to any disclaimer, the term of this patent is extended or adjusted under 35 U.S.C. 154(b) by 0 days.

(21) Appl. No.: 10/591,635

(22) PCT Filed: Mar. 18, 2005

(86) PCT No.: PCT/IB2005/000788

§ 371 (c)(1),
(2), (4) Date: Sep. 5, 2006

(87) PCT Pub. No.: WO2005/090642

PCT Pub. Date: Sep. 29, 2005

(65) Prior Publication Data

US 2007/0193878 A1 Aug. 23, 2007

(30) Foreign Application Priority Data

| | | |
|---|---|---|
| Mar. 18, 2004 | (WO) | PCT/IB2004/000886 |
| Apr. 29, 2004 | (WO) | PCT/IB2004/001416 |
| May 7, 2004 | (WO) | PCT/IB2004/001024 |

(51) Int. Cl.
*C25C 3/12* (2006.01)
*C25C 3/18* (2006.01)

(52) U.S. Cl. ..... 204/243.1; 204/245; 205/372; 205/384; 205/385; 205/387; 205/395

(58) Field of Classification Search ..... 204/243.1, 204/245; 205/372, 384, 385, 387, 394, 395
See application file for complete search history.

(56) References Cited

U.S. PATENT DOCUMENTS

| | | | | |
|---|---|---|---|---|
| 6,521,116 | B2 * | 2/2003 | Duruz et al. | 205/387 |
| 6,533,909 | B2 * | 3/2003 | Duruz et al. | 204/243.1 |
| 2003/0070937 | A1 * | 4/2003 | Duruz et al. | 205/372 |
| 2007/0144617 | A1 * | 6/2007 | De Nora et al. | 148/286 |
| 2008/0041729 | A1 * | 2/2008 | De Nora et al. | 205/380 |

* cited by examiner

*Primary Examiner*—Bruce F Bell
(74) *Attorney, Agent, or Firm*—Jayadeep R Deshmukh

(57) ABSTRACT

A cell for electrowinning aluminium from alumina, comprises: a metal-based anode having an electrochemically active outer part comprising a layer that contains predominantly cobalt oxide CoO; and a fluoride-containing molten electrolyte in which the active anode surface is immersed. The electrolyte is at a temperature below 950° C., in particular in the range from 910° to 940° C. The electrolyte consists of: 6.5 to 11 weight. % dissolved alumina; 35 to 44 weight % aluminium fluoride; 38 to 46 weight % sodium fluoride; 2 to 15 weight % potassium fluoride; 0 to 5 weight % calcium fluoride; and 0 to 5 weight % in total of one or more further constituents.

47 Claims, No Drawings

NON-CARBON ANODES WITH ACTIVE COATINGS

FIELD OF THE INVENTION

This invention relates to the use of a non-carbon anode in an adjusted fluoride-based molten electrolyte for the electrowinning of aluminium.

BACKGROUND ART

Using non-carbon anodes—i.e. anodes which are not made of carbon as such, e.g. graphite, coke, etc. . . . , but possibly contain carbon in a compound—for the electrowinning of aluminium should drastically improve the aluminium production process by reducing pollution and the cost of aluminium production. Many attempts have been made to use oxide anodes, cermet anodes and metal-based anodes for aluminium production, however they were never adopted by the aluminium industry.

For the dissolution of the raw material, usually alumina, a highly aggressive fluoride-based electrolyte, such as cryolite, is required.

Materials for protecting aluminium electrowinning components have been disclosed in U.S. Pat. Nos. 5,310,476, 5,340,448, 5,364,513, 5,527,442, 5,651,874, 6,001,236, 6,287,447 and in PCT publication WO01/42531 (all assigned to MOLTECH). Such materials are made predominantly (more than 50%) of non-oxide ceramic materials, e.g. borides, carbides or nitrides, for exposure to molten aluminium and to a molten fluoride-based electrolyte and have successfully been used in cathode applications. However, these non-oxide ceramic-based materials do not resist immediate exposure to anodically produced nascent oxygen.

The materials having the greatest resistance to oxidation are metal oxides which are all to some extent soluble in cryolite. Oxides are also poorly electrically conductive, therefore, to avoid substantial ohmic losses and high cell voltages, the use of non-conductive or poorly conductive oxides should be minimal in the manufacture of anodes. Whenever possible, a good conductive material should be utilised for the anode core, whereas the surface of the anode is preferably made of an oxide having a high electrocatalytic activity.

Several patents disclose the use of an electrically conductive metal anode core with an oxide-based active outer part, in particular U.S. Pat. Nos. 4,956,069, 4,960,494, 5,069,771 (all Nguyen/Lazouni/Doan), U.S. Pat. No. 6,077,415 (Duruz/de Nora), U.S. Pat. No. 6,103,090 (de Nora), U.S. Pat. No. 6,113,758 (de Nora/Duruz) and U.S. Pat. No. 6,248,227 (de Nora/Duruz), U.S. Pat. No. 6,361,681 (de Nora/Duruz), U.S. Pat. No. 6,365,018 (de Nora), U.S. Pat. No. 6,372,099 (Duruz/de Nora), U.S. Pat. No. 6,379,526 (Duruz/de Nora), U.S. Pat. No. 6,413,406 (de Nora), U.S. Pat. No. 6,425,992 (de Nora), U.S. Pat. No. 6,436,274 (de Nora/Duruz), U.S. Pat. No. 6,521,116 (Duruz/de Nora/Crottaz), U.S. Pat. No. 6,521,115 (Duruz/de Nora/Crottaz), U.S. Pat. No. 6,533,909 (Duruz/de Nora), U.S. Pat. No. 6,562,224 (Crottaz/Duruz) as well as PCT publications WO00/40783 (de Nora/Duruz), WO01/42534 (de Nora/Duruz), WO01/42535 (Duruz/de Nora), WO01/42536 (Nguyen/Duruz/de Nora), WO02/070786 (Nguyen/de Nora), WO02/083990 (de Nora/Nguyen), WO02/083991 (Nguyen/de Nora), WO03/014420 (Nguyen/Duruz/de Nora), WO03/078695 (Nguyen/de Nora), WO03/087435 (Nguyen/de Nora).

U.S. Pat. No. 4,374,050 (Ray) discloses numerous multiple oxide compositions for electrodes. Such compositions inter-alia include oxides of iron and cobalt. The oxide compositions can be used as a cladding on a metal layer of nickel, nickel-chromium, steel, copper, cobalt or molybdenum.

U.S. Pat. No. 4,142,005 (Cadwell/Hazelrigg) discloses an anode having a substrate made of titanium, tantalum, tungsten, zirconium, molybdenum, niobium, hafnium or vanadium. The substrate is coated with cobalt oxide $Co_3O_4$.

U.S. Pat. No. 6,103,090 (de Nora), U.S. Pat. No. 6,361,681 (de Nora/Duruz), U.S. Pat. No. 6,365,018 (de Nora), U.S. Pat. No. 6,379,526 (de Nora/Duruz), U.S. Pat. No. 6,413,406 (de Nora) and U.S. Pat. No. 6,425,992 (de Nora), and WO04/018731 (Nguyen/de Nora) disclose anode substrates that contain at least one of chromium, cobalt, hafnium, iron, molybdenum, nickel, copper, niobium, platinum, silicon, tantalum, titanium, tungsten, vanadium, yttrium and zirconium and that are coated with at least one of ferrites of cobalt, copper, chromium, manganese, nickel and zinc. WO01/42535 (Duruz/de Nora) and WO02/097167 (Nguyen/de Nora), disclose aluminium electrowinning anodes made of surface oxidised iron alloys that contain at least one of nickel and cobalt. U.S. Pat. No. 6,638,412 (de Nora/Duruz) discloses the use of anodes made of a transition metal-containing alloy having an integral oxide layer, the alloy comprising at least one of iron, nickel and cobalt.

Metal-based anodes are liable to corrosion and/or passivation in aluminium electrowinning cells. To avoid of minimise such mechanism, the composition and temperature of the cell's electrolyte should be chosen accordingly.

WO00/06804 discloses that a nickel-iron anode may be used in an electrolyte at a temperature of 820° to 870° C. containing 23 to 26.5 weight % $AlF_3$, 3 to 5 weight % $Al_2O_3$, 1 to 2 weight % LiF and 1 to 2 weight % $MgF_2$.

U.S. Pat. Nos. 5,006,209 and 5,284,562 (both Beck/Brooks), U.S. Pat. No. 6,258,247 and U.S. Pat. No. 6,379,512 (both Brown/Brooks/Frizzle/Juric), U.S. Pat. No. 6,419,813 (Brown/Brooks/Frizzle) and U.S. Pat. No. 6,436,272 (Brown/Frizzle) all disclose the use of nickel-copper-iron anodes in an aluminium production electrolyte at 660°-800° C. containing 6-26 weight % NaF, 7-33 weight % KF, 1-6 weight % LiF and 60-65 weight % $AlF_3$. The electrolyte may contain $Al_2O_3$ in an amount of up to 30 weight %, in particular 5 to 10 or 15 weight %, most of which is in the form of suspended particles and some of which is dissolved in the electrolyte, i.e. typically 1 to 4 weight % dissolved $Al_2O_3$. In U.S. Pat. Nos. 6,258,247, 6,379,512, 6,419,813 and 6,436,272 such an electrolyte is said to be useable at temperatures up to 900° C. In U.S. Pat. Nos. 6,258,247 and 6,379,512 the electrolyte further contains 0.004 to 0.2 weight % transition metal additives to facilitate alumina dissolution and improve cathodic operation.

U.S. Pat. No. 5,725,744 (de Nora/Duruz) discloses an aluminium production cell having anodes made of nickel, iron and/or copper in a electrolyte at a temperature from 680° to 880° C. containing 42-63 weight % $AlF_3$, up to 48 weight % NaF, up to 48 weight % LiF and 1 to 5 weight % $Al_2O_3$. $MgF_2$, KF and $CaF_2$ are also mentioned as possible bath constituents.

WO2004/035871 (de Nora/Nguyen/Duruz) discloses a metal-based anode containing at least one of nickel, cobalt and iron. The anode is used for electrowinning aluminium in a fluoride-containing molten electrolyte consisting of: 5 to 14 wt % dissolved alumina; 35 to 45 wt % aluminium fluoride; 30 to 45 wt % sodium fluoride; 5 to 20 wt % potassium fluoride; 0 to 5 wt % calcium fluoride; and 0 to 5 wt % of further constituents.

Non-carbon anodes have not as yet been commercially and industrially applied and there is still a need for a metal-based anodic material that can be used in an appropriate electrolyte for electrowinning aluminium.

SUMMARY OF THE INVENTION

The present invention generally relates to aluminium electrowinning with metal-based anodes having an electrochemically active outer part comprising a layer that contains predominantly cobalt oxide CoO in an electrolyte at reduced temperature containing a high concentration of dissolved alumina.

In particular, the invention relates to a cell for electrowinning aluminium from alumina. The cell comprises: a metal-based anode having an electrochemically active outer part comprising a layer that contains predominantly cobalt oxide CoO; and a fluoride-containing molten electrolyte in which the active anode surface is immersed. The molten electrolyte is at a temperature below 950° C., in particular in the range from 910° to 940° C. The molten electrolyte consists of: 6.5 to 11 weight % dissolved alumina; 35 to 44 weight % aluminium fluoride; 38 to 46 weight % sodium fluoride; 2 to 15 weight % potassium fluoride; 0 to 5 weight % calcium fluoride; and 0 to 5 weight % in total of one or more further constituents.

In other words, the invention concerns a cell having an anode with an outer part containing a special form of cobalt oxide, i.e. CoO, used in a molten electrolyte that is at a reduced temperature and that has an appropriate composition to enhance operation of the anode as described hereafter.

There are several forms of stoichiometric and non-stoichiometric cobalt oxides which are based on:

- CoO that contains Co(II) and that is formed predominantly at a temperature above 920° C. in air;
- $Co_2O_3$ that contains Co(III) and that is formed at temperatures up to 895° C. and at higher temperatures begins to decompose into CoO;
- $Co_3O_4$ that contains CO(II) and CO(III) and that is formed at temperatures between 300 and 900° C.

It has been observed that—unlike $Co_2O_3$ that is unstable and $Co_3O_4$ that does not significantly inhibit oxygen diffusion—CoO forms a well conductive electrochemically active material for the oxidation of oxygen ions and for inhibiting diffusion of oxygen. Thus this material forms a limited barrier against oxidation of the metallic cobalt body underneath.

The anode's CoO-containing layer can be a layer made of sintered particles, especially sintered CoO particles. Alternatively, the CoO-containing layer may be an integral oxide layer on a Co-containing metallic layer or anode core. Tests have shown that integral oxide layers have a higher density than sintered layers and are thus preferred to inhibit oxygen diffusion.

When CoO is to be formed by oxidising metallic cobalt, care should be taken to carry out a treatment that will indeed result in the formation of CoO. It was found that using $Co_2O_3$ or $Co_3O_4$ in a known aluminium electrowinning electrolyte does not lead to an appropriate conversion of these forms of cobalt oxide into CoO. Therefore, it is important to provide an anode with the CoO layer before the anode is used in an aluminium electrowinning electrolyte.

The formation of CoO on the metallic cobalt is preferably controlled so as to produce a coherent and substantially crack-free oxide layer. However, not any treatment of metallic cobalt at a temperature above 895° C. or 900° C. in an oxygen-containing atmosphere will result in optimal coherent and substantially crack-free CoO layer that offers better electrochemical properties than a $Co_2O_3/Co_3O_4$.

For instance, if the temperature for treating the metallic cobalt to form CoO by air oxidation of metallic cobalt is increased at an insufficient rate, e.g. less than 200° C./hour, a thick oxide layer rich in $Co_3O_4$ and in glassy $Co_2O_3$ is formed at the surface of the metallic cobalt. Such a layer does not permit optimal formation of the CoO layer by conversion at a temperature above 895° C. of $Co_2O_3$ and $Co_3O_4$ into CoO. In fact, a layer of CoO resulting from such conversion is not preferred but still useful despite an increased porosity and may be cracked. Therefore, the required temperature for air oxidation, i.e. above 900° C., usually at least 920° C. or preferably above 940° C. should be attained sufficiently quickly, e.g. at a rate of increase of the temperature of at least 300° C. or 600° C. per hour to obtain an optimal CoO layer. The metallic cobalt may also be placed into an oven that is pre-heated at the desired temperature above 900° C.

Likewise, if the anode is not immediately used for the electrowinning of aluminium after formation of the CoO layer but allowed to cool down, the cooling down should be carried out sufficiently fast, for example by placing the anode in air at room temperature, to avoid significant formation of $Co_3O_4$ that could occur during the cooling, for instance in an oven that is switched off.

An anode with a CoO layer obtained by slow heating of the metallic cobalt in an oxidising environment will not have optimal properties but still provides better results during cell operation than an anode having a $Co_2O_3$—$Co_3O_4$ layer and therefore also constitutes an improved aluminium electrowinning anode according to the invention.

The presence in the cell's electrolyte of potassium fluoride in the given amount has two effects. On the one hand, it leads to a reduction of the operating temperature by up to several tens of degrees without increase of the electrolyte's aluminium fluoride content or even a reduction thereof compared to standard electrolytes operating at about 950° C. with an aluminium fluoride content of about 45 weight %. On the other hand, it maintains a high solubility of alumina, i.e. up to above about 8 or 9 weight %, in the electrolyte even though the temperature of the electrolyte is reduced compared to conventional temperature.

Hence, in contrast to prior art low temperature electrolytes which carry large amounts of undissolved alumina in particulate form, according to the present invention a large amount of alumina in the electrolyte is in a dissolved form.

Without being bound to any theory, it is believed that combining a high concentration of dissolved alumina in the electrolyte and a limited concentration of aluminium fluoride leads predominantly to the formation of (basic) fluorine-poor aluminium oxyfluoride ions ($[Al_2O_2F_4]^{2-}$) instead of (acid) fluorine-rich aluminium oxyfluoride ions ($[Al_2OF_6]^{2-}$) near the anode. As opposed to acid fluorine-rich aluminium oxyfluoride ions, basic fluorine-poor aluminium oxyfluoride ions do not significantly dissolve the anode's CoO and do not noticeably passivate or corrode metallic cobalt. The weight ratio of dissolved alumina/aluminium fluoride in the electrolyte should be above 1/7, and often above 1/6 or even above 1/5, to obtain a favourable ratio of the fluorine-poor aluminium oxyfluoride ions and the fluorine-rich aluminium oxyfluoride ions.

It follows that the use of the above described electrolyte with metal-based anodes that contains CoO inhibits its dissolution, passivation and corrosion. Moreover, a high concentration of alumina dissolved in the electrolyte further reduces dissolution of oxides of the anode, in particular CoO.

In one embodiment, the electrolyte consists of: 7 to 10 weight % dissolved alumina; 36 to 42 weight % aluminium fluoride, in particular 36 to 38 weight %; 39 to 43 weight % sodium fluoride; 3 to 10 weight % potassium fluoride, such as 5 to 7 weight %; 2 to 4 weight % calcium fluoride; and 0 to 3 weight % in total of one or more further constituents. This corresponds to a cryolite-based ($Na_3AlF_6$) molten electrolyte containing an excess of aluminium fluoride ($AlF_3$) that is in the range of about 8 to 15 weight % of the electrolyte, in particular about 8 to 10 weight %, and additives that can include potassium fluoride and calcium fluoride in the abovementioned amounts.

The electrolyte can contain as further constituent(s) at least one fluoride selected from magnesium fluoride, lithium fluoride, cesium fluoride, rubidium fluoride, strontium fluoride, barium fluoride and cerium fluoride.

Advantageously, The electrolyte contains alumina at a concentration near saturation on the active anode surface.

In order to maintain the alumina concentration above a given threshold in the abovementioned range during normal electrolysis, the cell is preferably fitted with means to monitor and adjust the electrolyte's alumina content.

The CoO-containing anode layer can be integral with a core made of cobalt or a cobalt alloy. Such an anode core can be made of the same materials as the Co-containing alloys described below. The cobalt-containing anode core can advantageously be cast.

Alternatively, the anode comprises an electrically conductive substrate that is covered with an applied electrochemically active coating that comprises the CoO-containing layer.

The CoO-containing layer can be a layer of sintered particles. In particular, the CoO-containing layer can be formed by applying a layer of particulate CoO to the anode and sintering. For instance, the CoO-containing layer is applied as a slurry, in particular a colloidal and/or polymeric slurry, and then heat treated. Good results have been obtained by slurring particulate metallic cobalt or CoO, optionally with additives such as Ta, in an acqueous solution containing at least one of ethylene glycol, hexanol, polyvinyl alcohol, polyvinyl acetate, polyacrylic acid, hydroxy propyl methyl cellulose and ammonium polymethacrylate and mixtures thereof, followed by application to the anode, e.g. painting or dipping, and heat treating.

The CoO-containing layer can be an integral oxide layer on an applied Co-containing metallic layer of the coating.

The CoO-containing layer can be formed by applying a Co-containing metallic layer to the anode and subjecting the metallic layer to an oxidation treatment to form the CoO-containing layer on the metallic layer, the CoO-containing layer being integral with the metallic layer.

Conveniently, the oxidation treatment can be carried out in an oxygen containing atmosphere, such as air. The treatment can also be carried out in an atmosphere that is oxygen rich or consists essentially of pure oxygen.

It is also contemplated to carry out this oxidation treatment by other means, for instance electrolytically. However, it was found that full formation of the CoO integral layer cannot be achieved in-situ during aluminium electrowinning under normal cell operating conditions. In other words, when the anode is intended for use in a non-carbon anode aluminium electrowinning cell operating under the usual conditions, the anode should always be placed into the cell with a preformed integral oxide layer containing predominantly CoO.

As the conversion of Co(III) into Co(II) occurs at a temperature of about 895° C., the oxidation treatment should be carried out above this temperature. Usually, the oxidation treatment is carried out at a treatment temperature above 895° C. or 920° C., preferably above 940° C., in particular within the range of 950° C. to 1050° C. The Co-containing metallic layer can be heated from room temperature to this treatment temperature at a rate of at least 300° C./hour, in particular at least 450° C./hour, or is placed in an environment, in particular in an oven, that is preheated to said temperature. The oxidation treatment at this treatment temperature can be carried out for more than 8 or 12 hours, in particular from 16 to 48 hours. Especially when the oxygen-content of the oxidising atmosphere is increased, the duration of the treatment can be reduced below 8 hours, for example down to 4 hours.

The Co-containing metallic layer can be further oxidised during use. However, the main formation of CoO is preferably achieved before use and in a controlled manner for the reasons explained above.

The method for forming the CoO-containing layer on the Co-containing metallic layer can be used to form the CoO-containing layer on the previously mentioned Co-containing anode core.

The Co-containing metallic layer can contain alloying metals for further reducing oxygen diffusion and/or corrosion through the metallic layer.

In one embodiment, the anode comprises an oxygen barrier layer between the CoO-containing layer and the electrically conductive substrate. The oxygen barrier layer can contain at least one metal selected from nickel, copper, tungsten, molybdenum, tantalum, niobium and chromium, or an oxide thereof, for example alloyed with cobalt, such as a cobalt alloy containing tungsten, molybdenum, tantalum and/or niobium, in particular an alloy containing: at least one of nickel, tungsten, molybdenum, tantalum and niobium in a total amount of 5 to 30 wt %, such as 10 to 20 wt %; and one or more further elements and compounds in a total amount of up to 5 wt % such as 0.01 to 4 weight %, the balance being cobalt. These further elements may contain at least one of aluminium, silicon and manganese.

Typically, the oxygen barrier layer and the CoO-containing layer are formed by oxidising the surface of an applied layer of the abovementioned cobalt alloy that contains nickel, tungsten, molybdenum, tantalum and/or niobium. The resulting CoO-containing layer is predominantly made of CoO and is integral with the unoxidised part of the metallic cobalt alloy that forms the oxygen barrier layer.

When the CoO layer is integral with the cobalt alloy, the nickel, when present, should be contained in the alloy in an amount of up to 20 weight %, in particular 5 to 15 weight %. Such an amount of nickel in the alloy leads to the formation of a small amount of nickel oxide NiO in the integral oxide layer, in about the same proportions to cobalt as in the metallic part, i.e. 5 to 15 or 20 weight %. It has been observed that the presence of a small amount of nickel oxide stabilises the cobalt oxide CoO and durably inhibits the formation of $Co_2O_3$ or $Co_3O_4$. However, when the weight ratio nickel/cobalt exceeds 0.15 or 0.2, the advantageous chemical and electrochemical properties of cobalt oxide CoO tend to disappear. Therefore, the nickel content should not exceed this limit.

Alternatively, an oxygen barrier layer, for example made of the above cobalt alloy that contains nickel, tungsten, molybdenum, tantalum and/or niobium, can be covered with an applied layer of CoO or a precursor thereof, as discussed above. In this case the oxygen barrier layer can be an applied layer or it can be integral with the electrically conductive substrate.

In another embodiment, the Co-containing metallic layer consists essentially of cobalt, typically containing cobalt in an amount of at least 95 wt %, in particular more than 97 wt % or 99 wt %.

Optionally the Co-containing metallic layer contains at least one additive selected from silicon, nickel, manganese, niobium, tantalum and aluminium in a total amount of 0.1 to 2 wt %.

Such a Co-containing layer can be applied to an oxygen barrier layer which is integral with the electrically conductive substrate or applied thereto.

The electrically conductive substrate can comprise at least one metal selected from chromium, cobalt, hafnium, iron, molybdenum, nickel, copper, platinum, silicon, titanium, tungsten, molybdenum, tantalum, niobium, vanadium, yttrium and zirconium, or a compound thereof, in particular an oxide, or a combination thereof. For instance, the electrically conductive substrate may have an outer part made of cobalt or an alloy containing predominantly cobalt to which the coating is applied. For instance, this cobalt alloy contains nickel, tungsten, molybdenum, tantalum and/or niobium, in particular it contains: nickel, tungsten, molybdenum, tantalum and/or niobium in a total amount of 5 to 30 wt %, e.g. 10 to 20 wt %; and one or more further elements and compounds in a total amount of up to 5 wt %, the balance being cobalt. These further elements may contain at least one of aluminium, silicon and manganese. The electrically conductive substrate, or an outer part thereof, may contain or consist essentially of at least one oxidation-resistant metal, in particular one or more metals selected from nickel, tungsten, molybdenum, cobalt, chromium and niobium, and for example contains less than 1, 5 or 10 wt % in total of other metals and metal compounds, in particular oxides. Alternatively, the electrically conductive substrate can be made of an alloy of nickel, iron and copper, in particular an alloy containing: 65 to 85 weight % nickel; 5 to 25 weight % iron; 1 to 20 weight % copper; and 0 to 10 weight % further constituents. For example, the alloy contains about: 75 weight % nickel; 15 weight % iron; and 10 weight % copper.

Advantageously, the anode's CoO-containing layer, in particular when the CoO layer is integral with the applied Co-containing metallic layer or the anode body, has an open porosity of below 12%, such as below 7%.

The anode's CoO-containing layer can have a porosity with an average pore size below 7 micron, in particular below 4 micron. It is preferred to provide a substantially crack-free CoO-containing layer so as to protect efficiently the anode's metallic outer part which is covered by this CoO-containing layer.

Usually, the CoO-containing layer contains cobalt oxide CoO in an amount of at least 80 wt %, in particular more than 90 wt % or 95 wt % or 98 wt %.

Advantageously, the CoO-containing layer is substantially free of cobalt oxide $Co_2O_3$ and substantially free of $Co_3O_4$, and contains preferably below 3 or 1.5% of these forms of cobalt oxide.

The CoO-containing layer may be electrochemically active for the oxidation of oxygen ions during use, in which case this layer is uncovered or is covered with an electrolyte-pervious layer.

Alternatively, the CoO-containing layer can be covered with an applied protective layer, in particular an applied oxide layer such as a layer containing cobalt and/or iron oxide, e.g. cobalt ferrite. The applied protective layer may contain a pre-formed and/or in-situ deposited cerium compound, in particular cerium oxyfluoride, as for example disclosed in the abovementioned U.S. Pat. Nos. 4,956,069, 4,960,494 and 5,069,771. Such an applied protective layer is usually electrochemically active for the oxidation of oxygen ions and is uncovered, or covered in turn with an electrolyte pervious-layer.

The anode's electrochemically active surface can contain at least one dopant, in particular at least one dopant selected from iridium, palladium, platinum, rhodium, ruthenium, silicon, tungsten, molybdenum, tantalum, niobium, tin or zinc metals, Mischmetal and metals of the Lanthanide series, as metals and compounds, in particular oxides, and mixtures thereof. The dopant(s) can be present at the anode's surface in a total amount of 0.1 to 5 wt %, in particular 1 to 4 wt %.

Such a dopant can be an electrocatalyst for fostering the oxidation of oxygen ions on the anode's electrochemically active surface and/or can contribute to inhibit diffusion of oxygen ions into the anode.

The dopant may be added to the precursor material that is applied to form the active surface or it can be applied to the active surface as a thin film, for example by plasma spraying or slurry application, and incorporated into the surface by heat treatment.

The cell can have a cathode that has an aluminium-wettable surface, in particular a horizontal or inclined drained surface. This surface can be formed by an aluminium-wettable material that comprises a refractory boride and/or an aluminium-wetting oxide. Examples of such materials are disclosed in WO01/42168, WO01/42531, WO02/070783, WO02/096830 and WO02/096831 (all in the name of MOLTECH).

The anode can be suspended in the electrolyte by a stem, in particular a stem having an outer part comprising a layer that contains predominantly cobalt oxide CoO.

Another aspect of the invention relates to a method of electrowinning aluminium in a cell as described above The method comprises electrolysing the dissolved alumina to produce oxygen on the anode and aluminium cathodically, and supplying alumina to the electrolyte to maintain therein a concentration of dissolved alumina of 6.5 to 11 weight %, in particular 7 to 10 weight %.

Oxygen ions may be oxidised on the anode's CoO-containing layer that contains predominantly cobalt oxide CoO and/or, when present, on an active layer applied to the anode's CoO layer, the CoO layer inhibiting oxidation and/or corrosion of the anode's metallic outer part.

The invention will be further described in the following examples:

COMPARATIVE EXAMPLE 1

A cylindrical metallic cobalt sample was oxidised to form an integral cobalt oxide layer that did not predominantly contain CoO. The cobalt samples contained no more than a total of 1 wt % additives and impurities and had a diameter of 1.94 cm and a height of 3 cm.

Oxidation was carried out by placing the cobalt sample into an oven in air and increasing the temperature from room temperature to 850° C. at a rate of 120° C./hour.

After 24 hours at 850° C., the oxidised cobalt sample was allowed to cool down to room temperature and examined.

The cobalt sample was covered with a greyish oxide scale having a thickness of about 300 micron. This oxide scale was made of: a 80 micron thick inner layer that had a porosity of 5% with pores that had a size of 2-5 micron; and a 220 micron thick outer layer having an open porosity of 20% with pores that had a size of 10-20 micron. The outer oxide layer was made of a mixture of essentially $Co_2O_3$ and $Co_3O_4$. The denser inner oxide layer was made of CoO.

As shown in Comparative Examples 2 and 3, such oxidised cobalt provides poor results when used as an anode material in an aluminium electrowinning cell.

EXAMPLE 1a

A cobalt sample for use as an anode in a cell according to the invention was prepared as in Comparative Example 1 except that the sample was oxidised in an oven heated from room temperature to a temperature of 950° C. (instead of 850° C.) at the same rate (120° C./hour).

After 24 hours at 950° C., the oxidised cobalt sample was allowed to cool down to room temperature and examined.

The cobalt sample was covered with a black glassy oxide scale having a thickness of about 350 micron (instead of 300 micron). This oxide scale had a continuous structure (instead of a layered structure) with an open porosity of 10% (instead of 20%) and pores that had a size of 5 micron. The outer oxide layer was made of CoO produced above 895° C. from the conversion into CoO of $Co_3O_4$ and glassy $Co_2O_3$ formed below this temperature and by oxidising the metallic outer part of the sample (underneath the cobalt oxide) directly into CoO. The porosity was due to the change of phase during the conversion of $Co_2O_3$ and $Co_3O_4$ to CoO.

Such a material can be used as an aluminium electrowinning anode according to the invention. However, the density of the CoO layer and the performances of the anode can be further improved as shown in Examples 1c and 1d.

In general, to allow appropriate conversion of the cobalt oxide and growth of CoO from the metallic outer part of the substrate, it is important to leave the sample sufficiently long at a temperature above 895° C. The length of the heat treatment will depend on the oxygen content of the oxidising atmosphere, the temperature of the heat treatment, the desired amount of CoO and the amount of $Co_2O_3$ and $Co_3O_4$ to convert into CoO.

EXAMPLE 1b

Example 1a was repeated with a similar cylindrical metallic cobalt sample. The oven in which the sample was oxidised was heated to a temperature of 1050° C. (instead of 950° C.) at the same rate (120° C./hour).

After 24 hours at 1050° C., the oxidised cobalt sample was allowed to cool down to room temperature and examined.

The cobalt sample was covered with a black crystallised oxide scale having a thickness of about 400 micron (instead of 350 micron). This oxide scale had a continuous structure with an open porosity of 20% (instead of 10%) and pores that had a size of 5 micron. The outer oxide layer was made of CoO produced above 895° C. like in Example 1a.

Such a oxidised cobalt is comparable to the oxidised cobalt of Example 1a and can likewise be used as an anode material to produce aluminium.

In general, to allow appropriate conversion of the cobalt oxide and growth of CoO from the metallic outer part of the substrate, it is important to leave the sample sufficiently long at a temperature above 895° C. The length of the heat treatment above 895° C. will depend on the oxygen content of the oxidising atmosphere, the temperature of the heat treatment, the desired amount of CoO and the amount of $Co_2O_3$ and $Co_3O_4$ (produced below 895° C.) which needs to be converted into CoO.

EXAMPLE 1c (IMPROVED MATERIAL)

Example 1a was repeated with a similar cylindrical metallic cobalt sample. The oven in which the sample was oxidised was heated to the same temperature (950° C.) at a rate of 360° C./hour (instead of 120° C./hour).

After 24 hours at 950° C., the oxidised cobalt sample was allowed to cool down to room temperature and examined.

The cobalt sample was covered with a dark grey substantially non-glassy oxide scale having a thickness of about 350 micron. This oxide scale had a continuous structure with an open porosity of less than 5% (instead of 10%) and pores that had a size of 5 micron.

The outer oxide layer was made of CoO that was formed directly from metallic cobalt above 895° C. which was reached after about 2.5 hours and to a limited extent from the conversion of previously formed $Co_2O_3$ and $Co_3O_4$. It followed that there was less porosity caused by the conversion of $Co_2O_3$ and $Co_3O_4$ to CoO than in Example 1a.

Such an oxidised cobalt sample has a significantly higher density than the samples of Examples 1a and 1b, and is substantially crack-free. This oxidised cobalt constitutes a preferred material for making an improved aluminium electrowinning anode for use in a cell according to the invention.

EXAMPLE 1d (IMPROVED MATERIAL)

Example 1c was repeated with a similar cylindrical metallic cobalt sample. The oven in which the sample was oxidised was heated to the same temperature (1050° C.) at a rate of 600° C./hour (instead of 120° C./hour in Example 1a and 1b and 360° C./hour in Example 1c).

After 18 hours at 1050° C., the oxidised cobalt sample was allowed to cool down to room temperature and examined.

The cobalt sample was covered with a dark grey substantially non-glassy oxide scale having a thickness of about 300 micron (instead of 400 micron in Example 1b and 350 micron in Example 1c). This oxide scale had a continuous structure with a crack-free open porosity of less than 5% (instead of 20% in Example 1b) and pores that had a size of less than 2 micron (instead of 5 micron in Example 1b and in Example 1c).

The outer oxide layer was made of CoO that was formed directly from metallic cobalt above 895° C. which was reached after about 1.5 hours and to a marginal extent from the conversion of previously formed $Co_2O_3$ and $Co_3O_4$. It followed that there was significantly less porosity caused by the conversion of $Co_2O_3$ and $Co_3O_4$ to CoO than in Example 1b and in Example 1c.

Such an oxidised cobalt sample has a significantly higher density than the samples of Examples 1a and 1b, and is substantially crack-free. This oxidised cobalt constitutes a preferred material for making an improved aluminium electrowinning anode according to the invention.

COMPARATIVE EXAMPLE 2 (OVERPOTENTIAL TESTING)

An anode made of metallic cobalt oxidised under the conditions of Comparative Example 1 was tested in an aluminium electrowinning cell.

The cell's electrolyte was at a temperature of 925° C. and made of 11 wt % $AlF_3$, 4 wt % $CaF_2$, 7 wt % KF and 9.6 wt % $Al_2O_3$, the balance being cryolite $Na_3AlF_6$.

The anode was placed in the cell's electrolyte at a distance of 4 cm from a facing cathode. An electrolysis current of 7.3 A was passed from the anode to the cathode at an anodic current density of 0.8 A/cm$^2$.

The electrolysis current was varied between 4 and 10 A and the corresponding cell voltage measured to estimate the oxygen overpotential at the anode.

By extrapolating the cell's potential at a zero electrolysis current, it was found that the oxygen overpotential at the anode was of 0.88 V.

EXAMPLE 2 (OVERPOTENTIAL TESTING)

A test was carried out under the conditions of Comparative Example 2 with two anodes made of metallic cobalt oxidised under the conditions of Example 1c and 1d, respectively, in cells according to the invention using the same electrolyte as in Comparative Example 2. The estimated oxygen overpotential for these anodes were at 0.22 V and 0.21 V, respectively, i.e. about 75% lower than in Comparative Example 2.

It follows that the use of metallic cobalt covered with an integral layer of CoO instead of $Co_2O_3$ and $Co_3O_4$ as an aluminium electrowinning anode material in a cell according to the invention leads to a significant saving of energy.

COMPARATIVE EXAMPLE 3 (ALUMINIUM ELECTROWINNING)

Another anode made of metallic cobalt oxidised under the conditions of Comparative Example 1, i.e. resulting in a $Co_2O_3$ and $Co_3O_4$ integral surface layer, was tested in an aluminium electrowinning cell. The cell's electrolyte was at 925° C. and had the same composition as in Comparative Example 2. A nominal electrolysis current of 7.3 A was passed from the anode to the cathode at an anodic current density of 0.8 A/cm$^2$.

The cell voltage at start-up was above 20 V and dropped to 5.6 V after about 30 seconds. During the initial 5 hours, the cell voltage fluctuated about 5.6 V between 4.8 and 6.4 V with short peaks above 8 V. After this initial period, the cell voltage stabilised at 4.0-4.2 V.

Throughout electrolysis, fresh alumina was fed to the electrolyte to compensate for the electrolysed alumina.

After 100 hours electrolysis, the anode was removed from the cell, allowed to cool down to room temperature and examined.

The anode's diameter had increased from 1.94 to 1.97 cm. The anode's metallic part had been heavily oxidised. The thickness of the integral oxide scale had increased from 350 micron to about 1.1-1.5 mm. The oxide scale was made of: a 300-400 micron thick outer layer containing pores having a size of 30-50 micron and having cracks; a 1-1.1 mm thick inner layer that had been formed during electrolysis. The inner layer was porous and contained electrolyte under the cracks of the outer layer.

EXAMPLE 3 (ALUMINIUM ELECTROWINNING)

An anode made of metallic cobalt oxidised under the conditions of Example 1c, i.e. resulting in a CoO integral surface layer was tested in an aluminium electrowinning cell under the conditions of Comparative Example 3. A nominal electrolysis current of 7.3 A was passed from the anode to the cathode at an anodic current density of 0.8 A/cm$^2$.

At start-up the cell voltage was 4.1 V and steadily decreased to 3.7-3.8 V after 30 minutes (instead of 4-4.2 in Comparative Example 3). The cell voltage stabilised at this level throughout the test without noticeable fluctuations, unlike in Comparative Example 3.

After 100 hours electrolysis, the anode was removed from the cell, allowed to cool down to room temperature and examined.

The anode's external diameter did not change during electrolysis and remained at 1.94 cm. The metallic cobalt inner part underneath the oxide scale had slightly decreased from 1.85 to 1.78 cm. The thickness of the cobalt oxide scale had increased from 0.3 to 0.7-0.8 mm (instead of 1-1.1 mm of Comparative Example 3) and was made of: a non-porous 300-400 micron thick external layer; and a porous 400 micron thick internal layer that had been formed during electrolysis. This internal oxide growth (400 micron thickness over 100 hours) was much less than the growth observed in Comparative example 3 (1-1.1 mm thickness over 100 hours).

It follows that the anode's CoO integral surface layer inhibits diffusion of oxygen and oxidation of the underlying metallic cobalt, compared to the $Co_2O_3$ and $Co_3O_4$ integral surface layer of the anode of Comparative Example 3.

EXAMPLE 4 (VARIATIONS)

The anode material of Examples 1a to 1d, 2 and 3 can be covered upon formation of the integral CoO layer with a slurry applied layer, in particular containing $CoFe_2O_4$ particulate in a iron hydroxide colloid followed by drying at 250° C. to form a protective layer on the CoO integral layer.

EXAMPLE 5

A coated anode for use in a cell according to the invention was made by covering a metallic cobalt substrate with an applied electrochemically active coating comprising an outer CoO layer and an inner layer of tantalum and cobalt oxides.

The coating was formed by applying cobalt and tantalum using electrodeposition. Specifically, tantalum was dispersed in the form of physical inclusions in cobalt electrodeposits.

The electrodeposition bath had a pH of 3.0 to 3.5 and contained:

400 g/l $CoSO_4.7H_2O$;

40 g/l $H_3BO_3$;

40 g/l KCl; and 7-10 g/l Ta particles.

The tantalum particles had a size below 10 micron and were dispersed in the electrodeposition bath.

Electrodeposition on the cobalt substrate was carried out at a current density of 35 mA/cm$^2$ which led to a cobalt deposit containing Ta inclusions, the deposit growing at a rate of 45 micron per hour on the substrate.

After the deposit had reached a total thickness of 250-300 micron, electrodeposition was interrupted. The deposit contained 9-15 wt % Ta corresponding to a volume fraction of 4-7 v %.

To form a coating according to the invention, the substrate with its deposit were exposed to an oxidation treatment at a temperature of 950° C. The substrate with its deposit were brought from room temperature to 950° C. at a rate of 450-500° C./hour in an oven to optimise the formation of CoO instead of $Co_2O_3$ or $Co_3O_4$.

After 8 hours at 950° C., the substrate and the coating that was formed by oxidation of the deposit were taken out of the oven and allowed to cool down to room temperature. The coating had an outer oxide layer CoO on an inner oxide layer of Co—Ta oxides, in particular $CoTaO_4$, that had grown from the deposit. The innermost part of the deposit had remained unoxidised, so that the Co—Ta oxide layer was integral with the remaining metallic Co—Ta deposit. The Co—Ta oxide layer and the CoO layer had a total thickness of about 200 micron on the remaining metallic Co—Ta.

As demonstrated in Example 6, this CoO outer layer can act as an electrochemically active anode surface. The inner Co—Ta oxide layer inhibits oxygen diffusion towards the metallic cobalt substrate.

EXAMPLE 6

A coated anode was made of a cobalt substrate covered with a Co—Ta coating as in Example 5 and used in a cell for the electrowinning aluminium according to the invention.

The anode was suspended in the cell's electrolyte at a distance of 4 cm from a facing cathode. The electrolyte contained 11 wt % $AlF_3$, 4 wt % $CaF_2$, 7 wt % KF and 9.6 wt % $Al_2O_3$, the balance being $Na_3AlF_6$. The electrolyte was at a temperature of 925° C.

An electrolysis current was passed from the anode to the cathode at an anodic current density of 0.8 A/cm$^2$. The cell voltage remained remarkably stable at 3.6 V throughout electrolysis.

After 150 hours electrolysis, the anode was removed from the cell. No significant change of the anode's dimensions was observed by visual examination.

EXAMPLE 7

Example 5 was repeated by applying a Co—Ta coating onto an anode substrate made of a metallic alloy containing 75 wt % Ni, 15 wt % Fe and 10 wt % Cu.

The anode was tested as in Example 6 at an anodic current density of 0.8 A/cm$^2$. At start-up, the cell voltage was at 4.2 V and decreased within the first 24 hours to 3.7 V and remained stable thereafter.

After 120 hours electrolysis, the anode was removed from the cell. No sign of passivation of the nickel-rich substrate was observed and no significant change of dimensions of the anode was noticed by visual examination of the anode.

EXAMPLE 8

Examples 5 to 7 can be repeated by substituting tantalum with niobium.

EXAMPLE 9

Another anode for use in a cell according to the invention was made by applying a coating of Co—W onto an anode substrate made of a metallic alloy containing 75 wt % Ni, 15 wt % Fe and 10 wt % Cu.

The coating was formed by applying cobalt and tungsten using electrodeposition. The electrodeposition bath contained:

100 g/l $CoCl_2.6H_2O$;

45 g/l $Na_2WO_4.2H_2O$;

400 g/l $KNaC_4H_4O_6.4H_2O$; and 50 g/l $NH_4Cl$.

Moreover, $NH_4OH$ had been added to this bath so that the bath had reached a pH of 8.5-8.7.

Electrodeposition on the Ni—Fe—Cu substrate was carried out at a temperature of 82-90° C. and at a current density of 50 mA/cm$^2$ which led to a cobalt-tungsten alloy deposit on the substrate, the deposit growing at a rate of 35-40 micron per hour at a cathodic current efficiency of about 90%.

After the deposit had reached a total thickness of about 250 micron, electrodeposition was interrupted. The deposited cobalt alloy contained 20-25 wt % tungsten.

To form a coating according to the invention, the substrate with its deposit were exposed to an oxidation treatment at a temperature of 950° C. The substrate with its deposit were brought from room temperature to 950° C. at a rate of 450-500° C./hour in an oven to optimise the formation of CoO instead of $Co_2O_3$ or $Co_3O_4$.

After 8 hours at 950° C., the substrate and the coating that was formed by oxidation of the deposit were taken out of the oven and allowed to cool down to room temperature. The coating contained at its surface cobalt monoxide and tungsten oxide.

The structure of the coating after oxidation was denser and more coherent than the coating obtained by oxidising an electrodeposited layer of Ta—Co as disclosed in Example 1.

As demonstrated in Example 10, this coating can act as an electrochemically active anode surface. The presence of tungsten inhibits oxygen diffusion towards the metallic cobalt substrate.

EXAMPLE 10

An anode was made as in Example 9 and used in a cell for the electrowinning aluminium according to the invention.

The anode was suspended in the cell's electrolyte at a distance of 4 cm from a facing cathode. The electrolyte contained 11 wt % $AlF_3$, 4 wt % $CaF_2$, 7 wt % KF and 9.6 wt % $Al_2O_3$, the balance being $Na_3AlF_6$. The electrolyte was at a temperature of 925° C.

An electrolysis current was passed from the anode to the cathode at an anodic current density of 0.8 A/cm$^2$. The cell voltage remained stable at 3.5-3.7 V throughout electrolysis.

After 100 hours electrolysis, the anode was removed from the cell. No change of the anode's dimensions was observed by visual examination.

EXAMPLE 11

Examples 9 and 10 can be repeated with an anode substrate made of cobalt, nickel or an alloy of 92 wt % nickel and 8 wt % copper.

Comparative tests show that the use in a conventional cryolite-based electrolyte at 960° C. of a metal-based anode having an electrochemically active outer part comprising a layer that contains predominantly cobalt oxide CoO, leads to accelerated oxidation of the anode and dissolution into the electrolyte of oxides of the anode, in particular CoO. Moreover, use of such an anode in an electrolyte at 910°-940° C. without potassium fluoride leads to corrosion or passivation the anode.

The invention claimed is:

1. A cell for electrowinning aluminium from alumina, comprising:

a metal-based anode having an electrochemically active outer part comprising a layer that contains predominantly cobalt oxide CoO; and a fluoride-containing molten electrolyte in which the active anode surface is immersed, the electrolyte being at a temperature below 950° C., in particular in the range from 910° to 940° C., and consisting of:

6.5 to 11 weight % dissolved alumina;

35 to 44 weight % aluminium fluoride;

38 to 46 weight % sodium fluoride;

2 to 15 weight % potassium fluoride;

0 to 5 weight % calcium fluoride; and 0 to 5 weight % in total of one or more further constituents.

2. The cell of claim 1, wherein the electrolyte contains 7 to 10 weight % alumina.

3. The cell of claim 1, wherein the electrolyte contains 36 to 42 weight % aluminium fluoride, in particular 36 to 38 weight.

4. The cell of claim 1, wherein the electrolyte contains 39 to 43 weight % sodium fluoride.

5. The cell of claim 1, wherein the electrolyte contains 3 to 10 weight % potassium fluoride, in particular 5 to 7 weight %.

6. The cell of claim 1, wherein the electrolyte contains 2 to 4 weight % calcium fluoride.

7. The cell of claim 1, wherein the electrolyte contains up to 3 weight % of said one or more further constituents.

8. The cell of claim 1, wherein the electrolyte contains as further constituent(s) at least one fluoride selected from magnesium fluoride, lithium fluoride, cesium fluoride, rubidium fluoride, strontium fluoride, barium fluoride and cerium fluoride.

9. The cell of claim 1, wherein the electrolyte contains alumina at a concentration near saturation on the active anode surface.

10. The cell of claim 1, wherein the CoO-containing layer is integral with a core made of cobalt or a cobalt alloy.

11. The cell of claim 1, wherein the anode comprises an electrically conductive substrate that is covered with an applied electrochemically active coating that comprises the CoO-containing layer.

12. The cell of claim 11, wherein the CoO-containing layer is a layer of sintered particles.

13. The cell of claim 11, wherein the CoO-containing layer is an integral oxide layer on an applied Co-containing metallic layer of the coating.

14. The cell of claim 13, wherein the Co-containing metallic layer contains cobalt in an amount of at least 95 wt %, in particular more than 97 wt % or 99 wt %.

15. The cell of claim 13, wherein the Co-containing metallic layer contains at least one additive selected from silicon, manganese, nickel, niobium, tantalum and aluminium in a total amount of 0.1 to 2 wt %.

16. The cell of claim 11, which comprises an oxygen barrier layer between the CoO-containing layer and the electrically conductive substrate.

17. The cell of claim 16, wherein the oxygen barrier layer contains at least one metal selected from nickel, copper, tungsten, molybdenum, tantalum, niobium and chromium, or an oxide thereof.

18. The cell of claim 17, wherein the oxygen barrier layer further contains cobalt.

19. The cell of claim 18, wherein the oxygen barrier layer is a cobalt alloy containing at least one metal selected from nickel, tungsten, molybdenum, tantalum and niobium.

20. The cell of claim 19, wherein the cobalt alloy contains:

at least one of nickel, tungsten, molybdenum, tantalum and niobium in a total amount of 5 to 30 wt %, in particular 10-20 wt %; and one or more further elements and compounds in a total amount of up to 5 wt %, the balance being cobalt.

21. The cell of claim 20, containing as said further elements at least one of aluminium, silicon and manganese.

22. The cell of claim 16, wherein the CoO-containing layer is integral with the oxygen barrier layer.

23. The cell of claim 16, wherein the oxygen barrier layer is integral with the electrically conductive substrate.

24. The cell of claim 16, wherein the oxygen barrier layer and the CoO-containing layer, or precursors thereof, are distinct applied layers.

25. The cell of claim 11, wherein the electrically conductive substrate comprises at least one metal selected from chromium, cobalt, hafnium, iron, nickel, copper, platinum, silicon, tungsten, molybdenum, tantalum, niobium, titanium, tungsten, vanadium, yttrium and zirconium, or a compound thereof, in particular an oxide, or a combination thereof.

26. The cell of claim 25, wherein the electrically conductive substrate has an outer part made of cobalt or a cobalt-rich alloy to which the coating is applied.

27. The cell of claim 26, wherein the outer part is made of a cobalt-rich alloy containing at least one of nickel, tungsten, molybdenum, tantalum and niobium, said cobalt alloy containing in particular:

at least one of nickel, tungsten, molybdenum, tantalum and niobium in a total amount of 5 to 30 wt %, in particular 10-20 wt %; and one or more further elements and compounds in a total amount of up to 5 wt %, the balance being cobalt.

28. The cell of claim 25, wherein the electrically conductive substrate is an alloy of nickel, iron and copper, in particular an alloy containing: 65 to 85 weight % nickel; 5 to 25 weight % iron; 1 to 20 weight % copper; and 0 to 10 weight % further constituents.

29. The cell of claim 11, wherein the electrically conductive substrate contains or consists essentially of one or more oxidation-resistant metals.

30. The cell of claim 29, wherein said one or more oxidation-resistant metals is/are selected from nickel, cobalt, chromium and niobium.

31. The cell of claim 1, wherein the CoO-containing layer has an open porosity of up to 12%, in particular up to 7%.

32. The cell of claim 1, wherein the CoO-containing layer has a porosity with an average pore size below 7 micron, in particular below 4 micron.

33. The cell of claim 1, wherein the CoO-containing layer contains cobalt oxide CoO in an amount of at least 80 wt %, in particular more than 90 wt % or 95 wt %.

34. The cell of claim 1, wherein the CoO-containing layer is substantially free of $Co_2O_3$ and substantially free of $Co_3O_4$.

35. The cell of claim 1, wherein the CoO-containing layer is electrochemically active for the oxidation of oxygen ions and is uncovered or is covered with an electrolyte-pervious layer.

36. The cell of claim 1, wherein the CoO-containing layer is covered with an applied protective layer, in particular an applied oxide layer.

37. The cell of claim 36, wherein the applied protective layer contains cobalt oxide.

38. The cell of claim 36, wherein the applied protective layer contains iron oxide.

39. The cell of claim 38, wherein the applied protective layer contains oxides of cobalt and of iron, in particular cobalt ferrite.

40. The cell of claim 36, wherein the applied protective layer contains a cerium compound, in particular cerium oxyfluoride.

41. The cell of claim 36, wherein the applied protective layer is electrochemically active for the oxidation of oxygen ions and is uncovered or is covered with an electrolyte pervious-layer.

42. The cell of claim 1, which has an electrochemically active surface that contains at least one dopant, in particular at least one dopant selected from iridium, palladium, platinum, rhodium, ruthenium, silicon, tungsten, molybdenum, tantalum, niobium, tin or zinc metals, Mischmetal, metals of the Lanthanide series, as metals and compounds, in particular oxides, and mixtures thereof.

43. The cell of claim 42, wherein the electrochemically active surface is made of an active material containing the dopant(s) in a total amount of 0.1 to 5 wt %, in particular 1 to 4 wt %.

44. The cell of claim 1, comprising a cathode that has an aluminium-wettable surface, in particular a horizontal or inclined drained surface.

45. The cell of claim 44, wherein the cathode has an aluminium-wettable coating that comprises a refractory boride and/or an aluminium-wetting oxide.

46. The cell of claim 1, wherein the anode is suspended in the electrolyte by a stem, in particular a stem having an outer part comprising a layer that contains predominantly cobalt oxide CoO.

47. A method of electrowinning aluminium in a cell as defined in claim 1, comprising electrolysing the dissolved alumina to produce oxygen on the anode and aluminium cathodically, and supplying alumina to the electrolyte to maintain therein a concentration of dissolved alumina of 6.5 to 11 weight %, in particular 7 to 10 weight %.

* * * * *